US012012269B2

(12) United States Patent
Sperlik

(10) Patent No.: US 12,012,269 B2
(45) Date of Patent: Jun. 18, 2024

(54) STAIN AND PAINT CAN STORAGE SYSTEM AND METHOD

(71) Applicant: SOPHISTICATED SOLUTIONS, LLC, Orlando, FL (US)

(72) Inventor: Nathan Sperlik, Statham, GA (US)

(73) Assignee: SOPHISTICATED SOLUTIONS, LLC, Orlando, FL (US)

( * ) Notice: Subject to any disclaimer, the term of this patent is extended or adjusted under 35 U.S.C. 154(b) by 0 days.

(21) Appl. No.: 17/680,613

(22) Filed: Feb. 25, 2022

(65) Prior Publication Data

US 2022/0267070 A1 Aug. 25, 2022

Related U.S. Application Data

(60) Provisional application No. 63/153,518, filed on Feb. 25, 2021.

(51) Int. Cl.
*B65D 21/02* (2006.01)
*B65D 71/70* (2006.01)
(Continued)

(52) U.S. Cl.
CPC ..... *B65D 71/70* (2013.01); *B65D 21/02* (2013.01)

(58) Field of Classification Search
CPC ..... B44D 3/125; B44D 3/14; B65D 21/02; B65D 25/108; B65D 71/70; B65D 1/243; B65D 1/36; B65D 5/001; B65D 5/5038; B65D 5/5088; B65D 81/133; B65D 85/20; A47G 19/06; A47G 23/06
USPC ..... 206/501, 1.7, 1.8, 3, 15.2, 15.3, 45.28, 206/81, 205, 209, 210, 217, 219, 222, 206/225, 229, 304, 317, 349, 361, 362, 206/362.3, 362.4, 363, 372, 373, 427, 206/438, 446, 457, 459.5, 469, 486, 503, 206/504, 508, 509, 518, 519, 521, 527, 206/557, 564, 568, 575, 592, 764, 774, 206/818, 831; 15/247, 248.1, 257.01, 15/257.05, 257.06; 211/1.57, 10, 13.1,
(Continued)

(56) References Cited

U.S. PATENT DOCUMENTS 1,901,861 A 3/1933 Baker
4,998,696 A * 3/1991 Desjardins ..... B44D 3/162 248/176.1
(Continued)

FOREIGN PATENT DOCUMENTS

DE 19808013 A1 * 9/1999 ..... B65D 5/503
DE 19808013 A1 * 9/1999 ..... B65D 71/70
(Continued)

OTHER PUBLICATIONS

Written Opinion of the International Searching Authority dated May 18, 2022.
https://www.fixturescloseup.com.

*Primary Examiner* — Anthony D Stashick
*Assistant Examiner* — Marcos Javier Rodriguez Molina
(74) *Attorney, Agent, or Firm* — Jacob M. Ward; Ward Law Office LLC

(57) ABSTRACT

A storage device for a storage container includes a body having one or more retention means. Each retention means may accept and support one of a plurality of differently sized containers. Each retention means includes a first recess configured to engage a substantially cylindrical container and engage a substantially cuboid container.

15 Claims, 14 Drawing Sheets

(51) Int. Cl.

| | |
|---|---|
| *B44D 3/12* | (2006.01) |
| *B44D 3/14* | (2006.01) |
| *B65D 1/24* | (2006.01) |
| *B65D 25/10* | (2006.01) |

(58) Field of Classification Search

USPC .... 211/14, 36, 50, 55, 59.2, 59.4, 71.01, 78, 211/84, 85.7, 88.01, 90.02, 119.003, 211/126.1, 126.15, 128.1, 151, 153, 163, 211/193, 194; 215/12.2, 44, 202, 228, 215/231, 252, 303, 305, 306, 321, 329, 215/344, 364, 390, 391, 392; 217/26, 217/26.5; 220/1.5, 4.02, 4.22, 4.24, 4.25, 220/4.26, 4.27, 4.34, 6, 7, 8, 9.4, 23.2, 220/23.4, 23.6, 23.83, 23.86, 23.87, 220/23.88, 23.89, 62.14, 89.2, 200, 212, 220/212.5, 214, 229, 230, 231, 254.1, 220/254.2, 254.8, 255, 258.4, 259.2, 263, 220/265, 267, 268, 277, 282, 283, 284, 220/285, 288, 301, 304, 314, 315, 318, 220/319, 322, 324, 326, 328, 345.1, 361, 220/366.1, 367.1, 375, 377, 378, 380, 220/475, 476, 480, 481, 485, 494, 495, 220/495.02, 495.04, 495.06, 495.07, 220/495.09, 495.11, 500, 501, 502, 504, 220/505, 506, 507, 508, 509, 510, 516, 220/519, 521, 523, 524, 526, 528, 529, 220/532, 543, 545, 550, 553, 555, 556, 220/559, 564, 565, 570, 571, 571.1, 572, 220/573.1, 573.2, 576, 578, 581, 592.02, 220/592.2, 600, 601, 607, 608, 610, 619, 220/620, 622, 630, 659, 666, 675, 676, 220/694, 695, 696, 697, 698, 699, 700, 220/702, 731, 732, 735, 736, 739, 740, 220/752, 753, 754, 755, 756, 757, 759, 220/760, 761, 762, 763, 764, 765, 766, 220/768, 769, 770, 771, 772, 773, 774, 220/776, 780, 781, 783, 784, 789, 792, 220/793, 795, 796, 801, 803, 826, 827, 220/831, 832, 835, 836, 837, 840, 847, 220/849, 901, 908, 916, DIG. 5, 223, 220/23.8, 4.01, 4.33, 511, 512, 513, 515, 220/517, 518, 533, 605, 62, 632, 643, 220/644, 645, 665, 669, 671, 681, 690, 220/737; 224/42.12, 42.14, 42.2, 42.24, 224/42.32, 42.38, 153, 219, 222, 242, 224/255, 267, 270, 275, 277, 282, 311, 224/321, 148.2, 148.4, 148.5, 148.6, 224/148.7, 183, 191, 195, 197, 199; 248/37.3, 49, 51, 58, 60, 61, 65, 68.1, 70, 248/105, 118, 121, 125.9, 156, 158, 172, 248/176.1, 176.3, 177.1, 188, 188.2, 201, 248/205.2, 206.3, 206.5, 210, 218.4, 248/220.21, 220.31, 222.52, 223.41, 248/224.51, 228.3, 238, 250, 276.1, 248/280.11, 282.1, 289.11, 298.1, 304, 248/309.1, 309.2, 311.2, 312, 313, 248/346.01, 346.11, 349.1, 422, 424, 248/442.2, 447.1, 447.2, 451, 455, 456, 248/458, 461, 462, 468, 507, 523, 558, 248/652, 683, 684, 918; 81/3.32, 3.36; D24/227

See application file for complete search history.

(56) References Cited

U.S. PATENT DOCUMENTS

| | | | | |
|---|---|---|---|---|
| 5,501,352 | A | 3/1996 | Apps | |
| 7,503,454 | B2 | 3/2009 | Gorman | |
| 7,779,762 | B2 | 8/2010 | Sackman | |
| 8,328,013 | B2 | 12/2012 | Stevens | |
| 8,657,144 | B2 | 2/2014 | Kells | |
| 9,393,979 | B1 | 7/2016 | Milton | |
| D791,544 | S | 7/2017 | Dennis | |
| 2003/0006156 | A1 | 1/2003 | McCracken et al. | |
| 2005/0274575 | A1* | 12/2005 | Gibson | E06C 7/14 182/129 |
| 2006/0108192 | A1 | 5/2006 | Bastarache | |
| 2006/0219586 | A1* | 10/2006 | Phillips | B44D 3/123 206/561 |
| 2010/0084297 | A1 | 4/2010 | Apps | |
| 2010/0108685 | A1 | 5/2010 | Mills, II | |
| 2013/0068635 | A1 | 3/2013 | Ralph | |
| 2013/0277257 | A1* | 10/2013 | Aronoff | B65D 85/00 206/373 |
| 2014/0165467 | A1 | 6/2014 | DeYoung et al. | |
| 2016/0200479 | A1 | 7/2016 | Clark et al. | |

FOREIGN PATENT DOCUMENTS

| | | | | | |
|---|---|---|---|---|---|
| GB | 2461327 | A | | 12/2009 | |
| JP | 2015042522 | A | * | 3/2015 | B60N 3/10 |
| JP | 2015042522 | A | * | 3/2015 | B60N 3/10 |
| JP | 2015042522 | A | * | 3/2016 | B60N 3/10 |

* cited by examiner

STAIN AND PAINT CAN STORAGE SYSTEM AND METHOD

CROSS-REFERENCE TO RELATED APPLICATIONS

This application claims the benefit of U.S. Provisional Application No. 63/153,518, filed on Feb. 25, 2021. The entire disclosure of the above application is incorporated herein by reference.

FIELD

The disclosure generally relates to storage systems and, more particularly, to storage systems for painting equipment.

INTRODUCTION

This section provides background information related to the present disclosure which is not necessarily prior art.

There are few options currently available for consumers and professional painters to neatly and compactly organize and store tools and painting equipment prior to commencing a project. Painters generally require a great number of tools, accessories, and supplies to complete a given project properly, including different sized brushes, rollers, applicators, paint cans, and stain containers. Organizing these objects in a single location can be difficult. Certain objects are often discarded or lost after use, as tools can be scattered and improperly handled between jobs. Paint cans and stain containers may also undesirably tip over and possibly spill. This can be wasteful, and time consuming, as new tools and materials need to be purchased to replace the missing or ruined items.

As can be seen, there is a need for an improved device that provides an organized and convenient storage system for housing and transporting painting tools and materials, while also preventing punctures and damage to containers. The system should have the ability to accommodate a variety of painting tools and applicators, while storing them in a compact and neatly organized fashion. The system should be easy to handle, allowing a user to transport the tools, accessories, and supplies between job sites with ease. The system should provide a retainment means such that the tools and painting materials are supported to militate against undesirable movements during transport.

SUMMARY

In concordance with the instant disclosure, a convenient storage system that organizes painting materials and retains paint cans of multiple shapes and sizes in a supported position, has been surprisingly discovered.

In a first example embodiment, a storage device includes a body including one or more retention means. Each retention means may be configured to accept and support a plurality of differently sized containers. Each retention means may include a first recess configured to engage a substantially cylindrical container and engage a substantially cuboid container. Each retention means may further include a second recess within the first recess for separately engaging a second container. The first container and the second container may be different sizes.

Each retention means may further include one or more protrusions. One of the first recess and the second recess may be configured to engage a substantially cylindrical container and engage a substantially cuboid container. The first recess and the second recess may include opposing substantially flat sides configured to engage a substantially cuboid container and opposing curved sides configured to engage a substantially cylindrical container. In certain embodiments, each of the first recess and the second recess is configured to engage a substantially cylindrical container and engage a substantially cuboid container. In addition, the first recess may be disposed substantially orthogonal with respect to the second recess. Each of the first recess and the second recess may include a pair of substantially curved sides and a pair of substantially flat sides.

In certain embodiments, the body further includes a top surface disposed on a first plane, the first recess disposed on a second plane at a first distance beneath the first plane, the second recess disposed on a third plane at a second distance beneath the second plane, the first plane, the second plane, and the third plane comprising parallel planes. The first distance and the second distance may be a different distance. In certain embodiments, the storage device may include one or more raised walls that include an outside lip along an edge of the one or more raised walls. The outside lip may be defined by an interior recess on an underside of the outside lip.

In a second example embodiment, a storage system includes a storage device. The storage device includes a body including one or more retention means. Each retention means may accept and support a plurality of differently sized containers. Additionally, each retention means may include a first recess configured to engage a substantially cylindrical container and engage a substantially cuboid container. The storage device may be configured to be removably held within a storage container.

In certain embodiments, the storage device is configured to be removably held within the storage container by a friction fit when the storage device is placed within the storage container. The body of the storage device may include a raised side having an outside lip that fits over an edge of the storage container to secure the storage device within the storage container. The outside lip may include one or more tabs that snap onto the edge of the storage container to secure the storage device within the storage container. In addition, when the storage device is received within the storage container, a compartment is formed therebetween that is configured to store one or more tools and/or equipment.

In another embodiment, a method of using a storage system may include providing a storage device including a body including one or more retention means. Each retention means may accept and support a plurality of differently sized containers. Each retention means may include a first recess configured to engage a substantially cylindrical container and engage a substantially cuboid container.

The method may also include performing one of disposing the first container on the first recess and removing the first container from the first recess. In certain embodiments, when the storage device is received within a storage container, a compartment is formed therebetween that is configured to store one or more tools and/or equipment. The method can further include, disposing one or more tools in the compartment before removably receiving the storage device into the storage container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
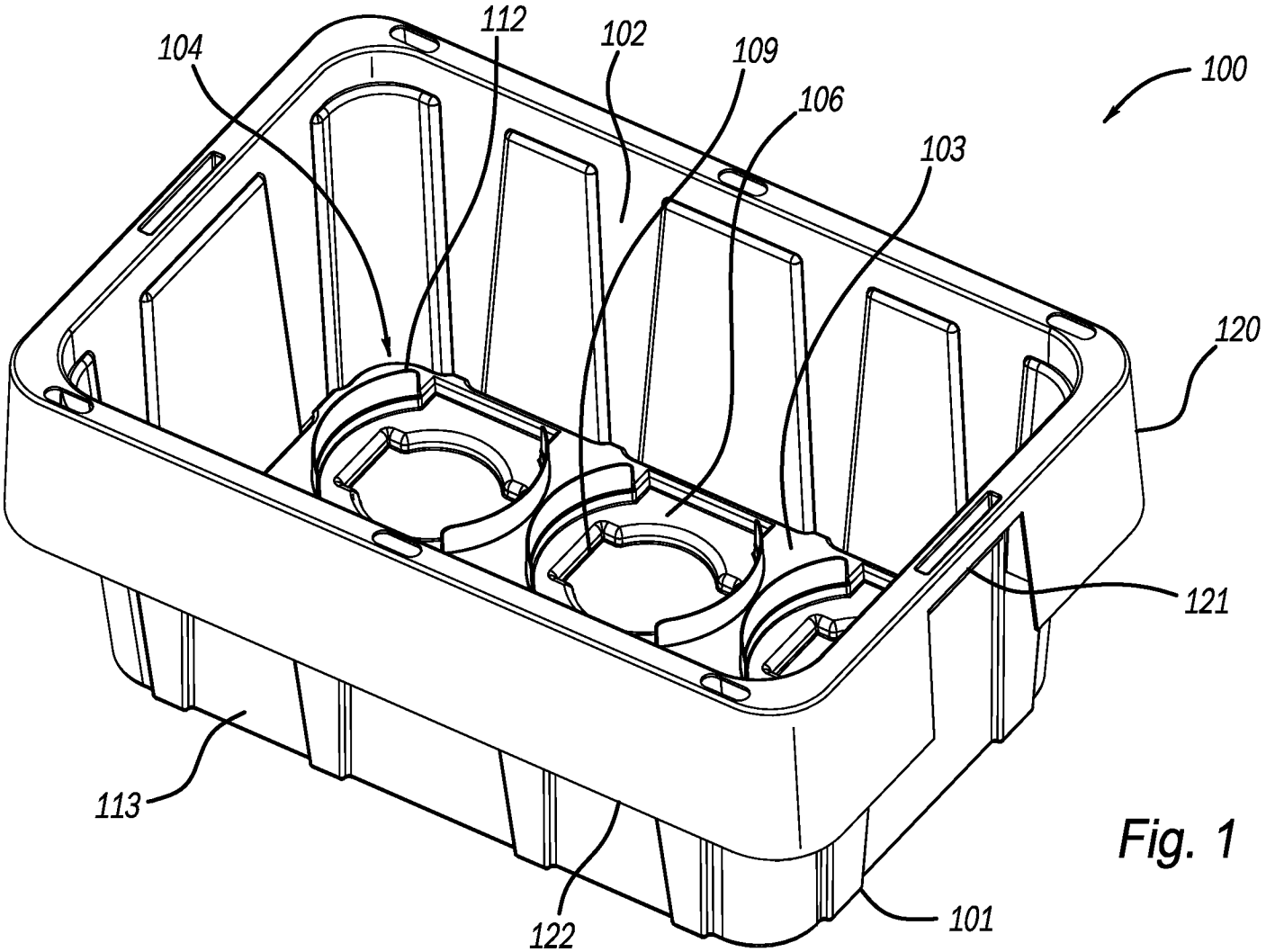
FIG. 1 is a top perspective view of an embodiment of a storage device for a storage system, in accordance with the present technology.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In concordance with the present technology, a container storage system is provided for storing containers, such as paint containers. The container storage system may include a storage device that has a retention means configured to accept and support a container of more than one shape and/or size. The storage device may have a plurality of retention means configured to support more than one container. Each retention means may be configured to support containers of different shapes and/or sizes. The retention means may include one of a recess, a protrusion, or a combination of recesses and/or protrusions. Advantageously, the storage device may be configured to be selectively disposed into a storage container for more protection during storage and transport of one or more containers and other related items.

In certain embodiments, the retention means may include a first recess configured to accept and support each of a substantially cylindrical container and a substantially cuboid container. As a non-limiting example, the substantially cylindrical container may be a 1-gallon cylindrical can, a 1-quart cylindrical can, and a 1-liter cylindrical can. As another non-limiting example, the substantially cuboid container may be a 1-gallon rectangular can, a 1-quart rectangular can and a 1-liter rectangular can. In a specific example, the retention means may include a second recess configured to accept and support a second substantially cylindrical container. The second recess may be smaller than the first recess and further disposed within the first recess. As a non-limiting example, the second substantially cylindrical container may be a 1-pint can. In particular, the retention means may include a first recess and a second recess configured to engage any appropriately desired sized can or container, including one or more metric or imperial sized cans or containers. The top surface of the storage device may be disposed on a first plane. The first recess may be disposed on a second plane substantially parallel with the first plane. The second plane may be disposed at a first distance beneath the first plane. The second recess may be disposed on a third plane, which is substantially parallel with each of the first plane and the second plane. The third plane may be disposed at a second distance beneath the second plane. Advantageously, the first recess and the second recess permit each retention means to accept and support a plurality of containers of different shapes and sizes.

In certain embodiments, when received within a storage container, the storage device may include a compartment configured to secure tools and/or equipment. Non-limiting examples of the tools may include paint keys, stir sticks, and paint brushes. In a specific example, there may be a plurality of compartments configured to secure painting tools. Advantageously, the compartment may provide enhanced organization and convenience.

In certain embodiments, a handle may be disposed on the storage device. The handle may provide a more ergonomic way to insert and remove the storage device from a storage container and to carry the storage device. When the storage device is disposed within the storage container, a perimeter of the storage device may abut a sidewall of the storage container. Advantageously, the handle is disposed on the top surface of the storage device to allow a user to easily lift or lower the storage device without touching or pinching their hand against the sidewall of the storage container.

Various ways of using the paint storage system are provided. Certain methods may include a step of providing the tray with a retention means configured to accept and support a container of more than one shape and/or size. Next, the method may include a step of performing one of disposing an object on the tray and removing an object from the tray.

Advantageously, the painting storage system as described herein can organize containers in a supported position for enhanced protection during storage and transport. Desirably, each of the retention means may be configured to retain containers of multiple shapes and sizes. When placed within a storage container, the storage device can securely hold and support one or more containers of different sizes and shapes. In addition, although the storage device is shown inserted into a storage container, it is contemplated that in certain embodiments the storage device could be used by itself to hold and carry one or more containers. As such, the storage system as described by the present technology has many advantages.

EXAMPLES

Example embodiments of the present technology are provided with reference to the several figures enclosed herewith.

Figure 2:
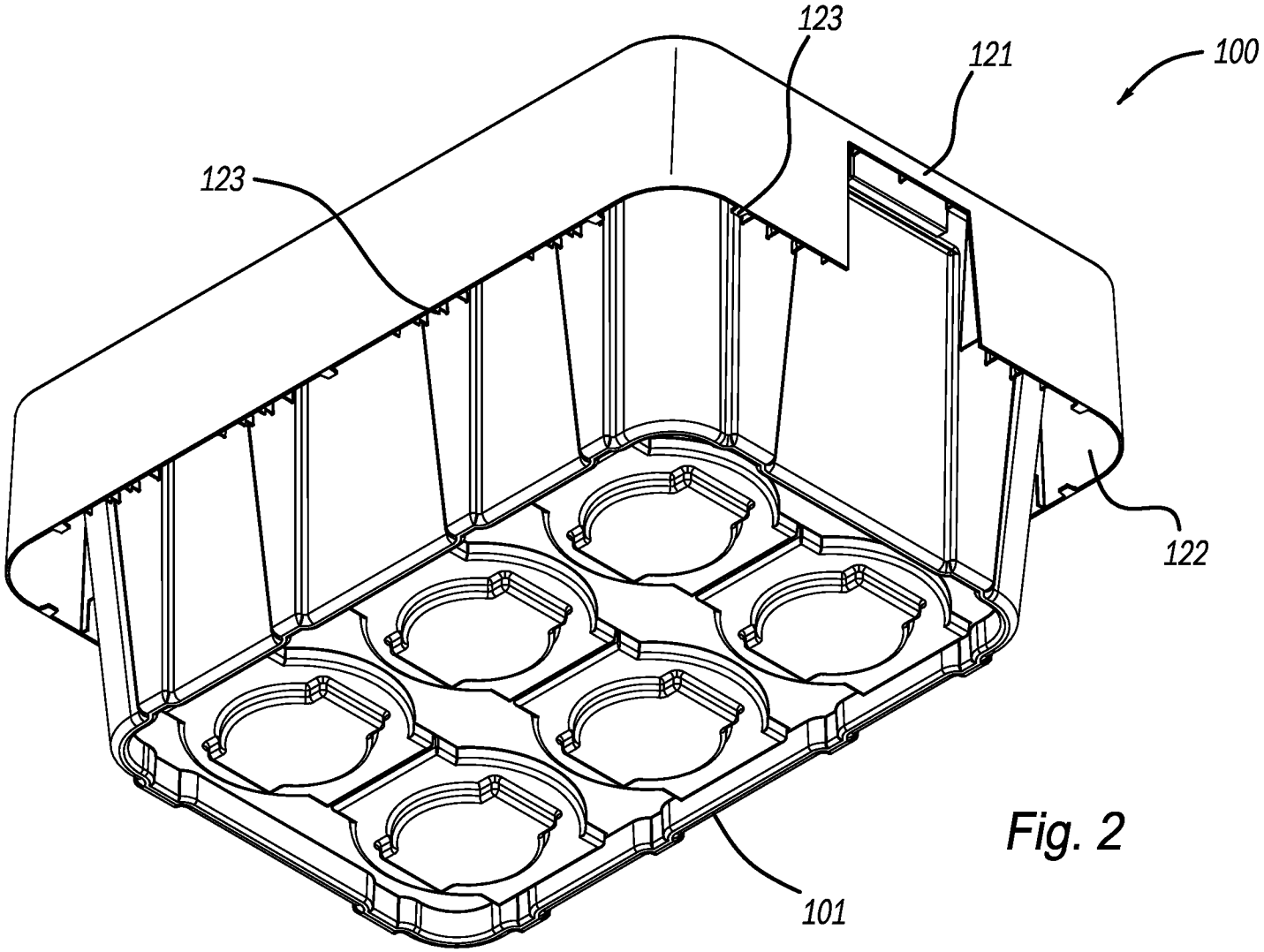
FIG. 2 is a bottom perspective view of the storage device for the storage system, in accordance with the present technology.

As shown in FIGS. 1 and 2, a storage device 100 for a storage container is provided. The storage device has a body 101 including an interior 102 with one or more retention means 104. The one or more retentions means 104 may be configured to accept and support containers of more than one shape and/or size. For example, the one or more retention means 104 may be configured to accept and support one or more of a substantially cylindrical container and a substantially cuboid container. As a non-limiting example, the substantially cylindrical container may be a 1-gallon cylindrical can, a 1-quart cylindrical can, and a 1-liter cylindrical can. As another non-limiting example, the substantially cuboid container may be a 1-gallon rectangular can, a 1-quart rectangular can, and a 1-liter rectangular can. However, as would be evident to someone of ordinary skill in the art, the one or more retention means 104 may be configured to hold any appropriately desired size and shape of container. In some embodiments, the one or more retention means 104 may include a first recess 106, a second recess 109 and one or more protrusions 112. The body 101 may also include one or more handles 121 and an outside lip 120. The outside lip 120 may include an interior recess 122 which fits over an outside edge 131 of a storage container 130 to secure the storage device 100 within the storage container 130 when it is placed into the storage container 130. One or more ribbed surfaces 123 of the storage device 100 may rest on the storage container 130 when the storage device 100 is placed in the storage container 130. The body 101 may include one or more raised walls 113. As shown, the body 101 comprises four raised walls 113 in generally a rectangular configuration. However, it is contemplated that the body 101 may be configured using various shapes and cross-sections by having various types and numbers of raised walls 113. For example, in certain embodiments, the body may be cylindrical including one raised wall 113, whereas other embodiments can include raise walls forming various polygonal cross-sections.

The body 101 includes a top surface 103 that holds the one or more retention means 104. The one or more retention means 104 may include one or more protrusions 112, a first recess 106, and a second recess 109 within the first recess 106. The first recess 106 and the second recess 109 may be configured to accept differently sized and/or differently shaped containers.

Figure 8A:
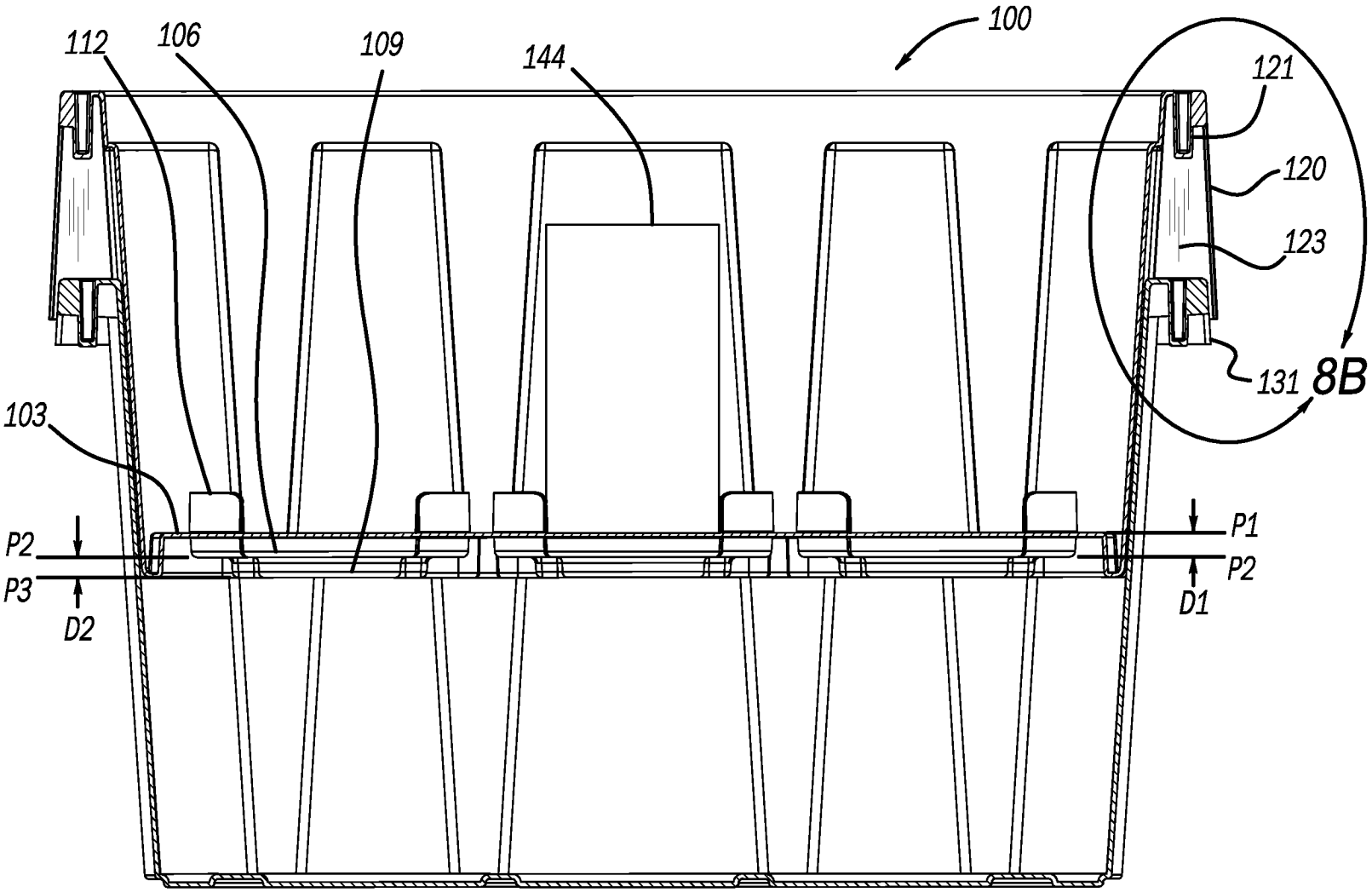
FIG. 8A is a cross-sectional view along the line 8-8 in FIG. 7 of the storage device received within the storage container, in accordance with the present technology.

As shown in FIG. 8A, the top surface 103 may comprise a first plane P1, the first recess 106 may comprise a second plane P2, below the first plane, and the second recess 109 may comprise a third plane P3, below the first plane P1 and the second plane P2. The first plane P1, the second place P2 and the third plane P3 may comprise parallel planes. In some embodiments, the second plane P2 may be disposed at a first distance D1 beneath the first plane P1 and the third plane P3 may be disposed at a second distance D2 beneath the second plane P2. The first distance D1 and the second distance D2 may be the same distance. Alternatively, the first distance D1 and the second distance D2 may be a different distance.

Figure 3:
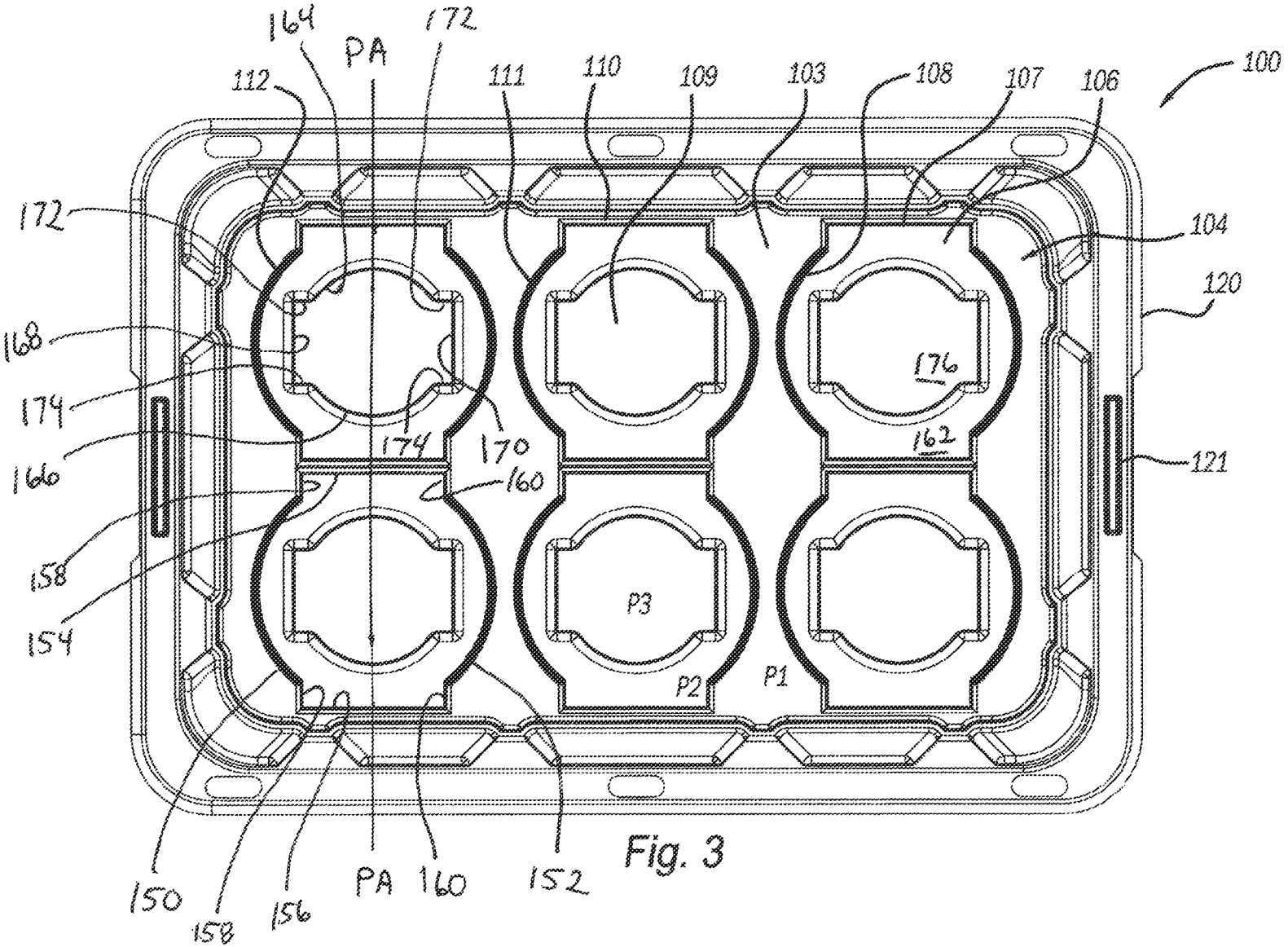
FIG. 3 is a top plan view of the storage device for the storage system, in accordance with the present technology.

In some embodiments, the first recess 106 is a first size and the second recess 109 is a second size, smaller than the first size. For example, the first recess 106 may be a first size configured to accept and support a large size container while the second recess 109 may be a second size configured to accept and support a smaller size container. Advantageously, the first recess 106 and the second recess 109 may be any appropriately desired size to permit the one or more retention means 104 to accept and support a plurality of containers of different shapes and sizes. In some embodiments, such as shown in FIG. 3, the first recess 106 is disposed substantially orthogonal with respect to the second recess 109. In certain embodiments, the first recess 106 is disposed at a 90° angle with respect to the second recess 109.

As shown within FIG. 3, the first recess 106 includes a plurality of substantially flat sides 107 and a plurality of substantially curved sides 108. Similarly, the second recess 109 may include a plurality of substantially flat sides 110 and a plurality of substantially curved sides 111. In this manner, the first recess 106 and the second recess 109 may each accept a substantially cylindrical container 141 and a substantially cuboid container 142. For example, in some embodiments, the first recess 106 and the second recess 109 are each able to accept and support a cylindrical container, such as a paint container and a cuboid container, such as a paint thinner container. It should be appreciated, however, that the first recess 106 and the second recess 109 may hold any desired cylindrical and/or cuboid shaped containers as appropriately desired. It should also be appreciated that the first recess 106 and the second recess 109 may be shaped for holding other appropriately shaped containers. As further, shown within FIG. 3, the storage device 100 comprise two rows of three retention means. However, the storage device 100 is able to comprise any appropriately number of retention means as appropriately desired.

Figure 10:
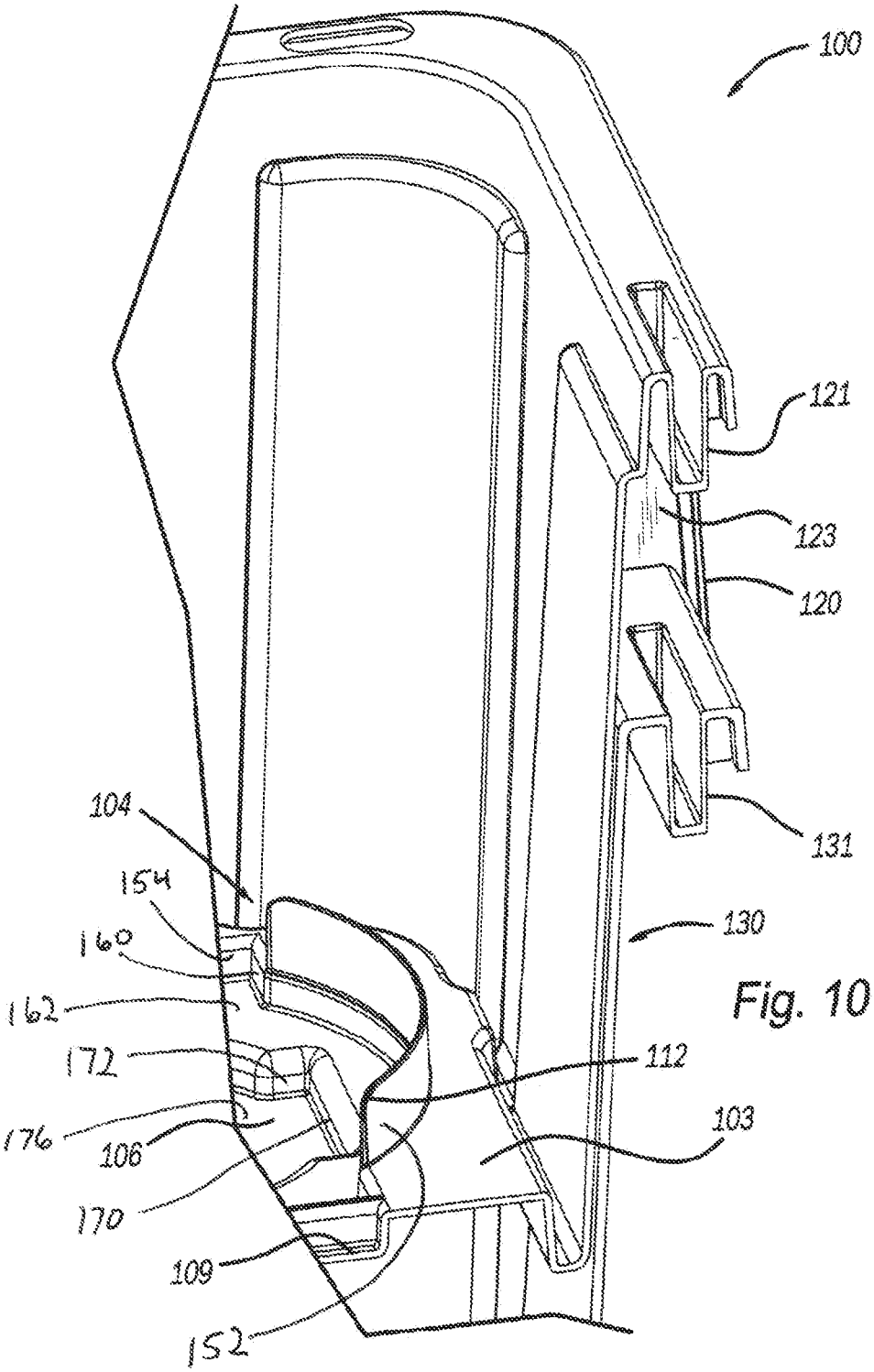
FIG. 10 is a cut-away cross-sectional view along the line 8-8 in FIG. 7 of the storage device received within the storage container, in accordance with the present technology.

As shown in FIGS. 3 and 10, the first recess 106 can be elongated and oriented on and/or so that the longer sides of the first recess 106 is substantially parallel to a primary axis PA of the retention means 104. The first recess 106 can be defined by a first curved wall 150, a second curved wall 152, a first flat wall 154, a second flat wall 156, and two pairs of connecting walls 158, 160, all of which extend from a bottom surface 162 of the first recess 106. The first curved wall 150 can be disposed opposite the second curved wall 152. The first flat wall 154 can be disposed opposite the second flat wall 152. The first curved walls 150 and the second curved wall 152 can be connected to each of the first flat wall 154 and the second flat wall 146 with one of the two pairs of connecting walls 158, 160. The first flat wall 154 and the second flat wall 156 can be disposed substantially perpendicular to the primary axis PA. The first curved wall 150 and the second curved wall 152 of the first recess 106 can extend above the top surface 103 and thus be configured to engage and facilitate securely holding either a substantially cylindrical container or a substantially cuboid container.

The second recess 109 disposed within the first recess 106 can be elongated and oriented so that the longer sides of the second recess 109 is substantially perpendicular to the primary axis PA. The second recess 109 can be defined by a third curved wall 164, a fourth curved wall 166, a third flat wall 168, a fourth flat wall 170, and two other pairs of connecting walls 172, 174 extending from the a second bottom surface 176 of the second recess 109. The third curved wall 162 can be disposed opposite the fourth curved wall 164. The third flat wall 166 can be disposed opposite the fourth flat wall 168. The third curved wall 162 and the fourth curved wall 164 can be connected to each of the third flat wall 166 and the fourth flat wall 168 with one of the two other pairs of connecting walls 170, 172. The third flat wall 166 and the fourth flat wall 168 can be disposed substantially parallel to the primary axis PA. The second recess 109 can thus be configured to separately engage and securely hold a second container and position the second container atop the third plane P3 regardless of the second container being a substantially cylindrical container or a substantially cuboid container, where the first container and the second container can be different sizes.

Figure 4:
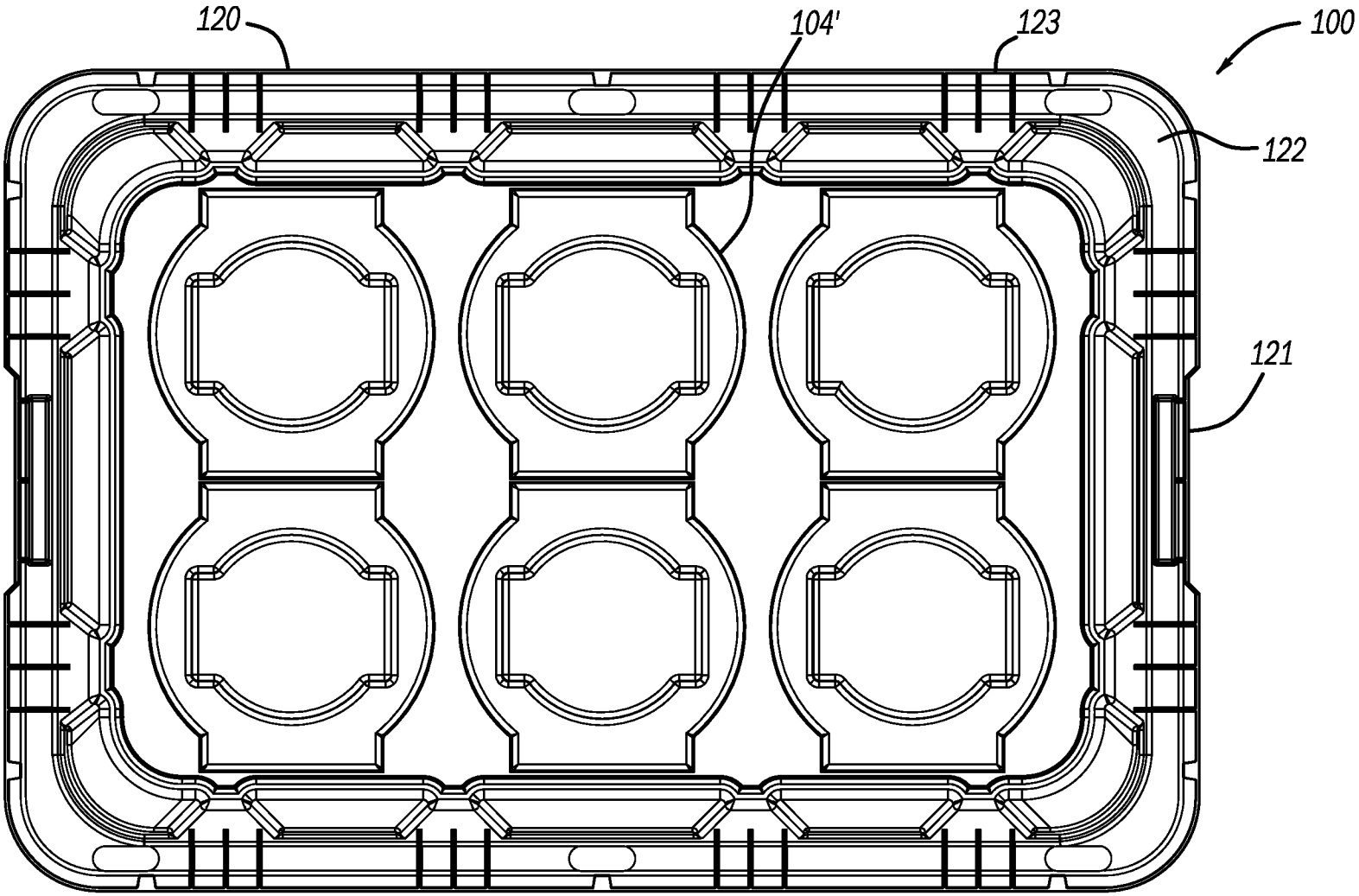
FIG. 4 is a bottom plan view of the storage device for the storage system in accordance with the present technology.
Figure 5:
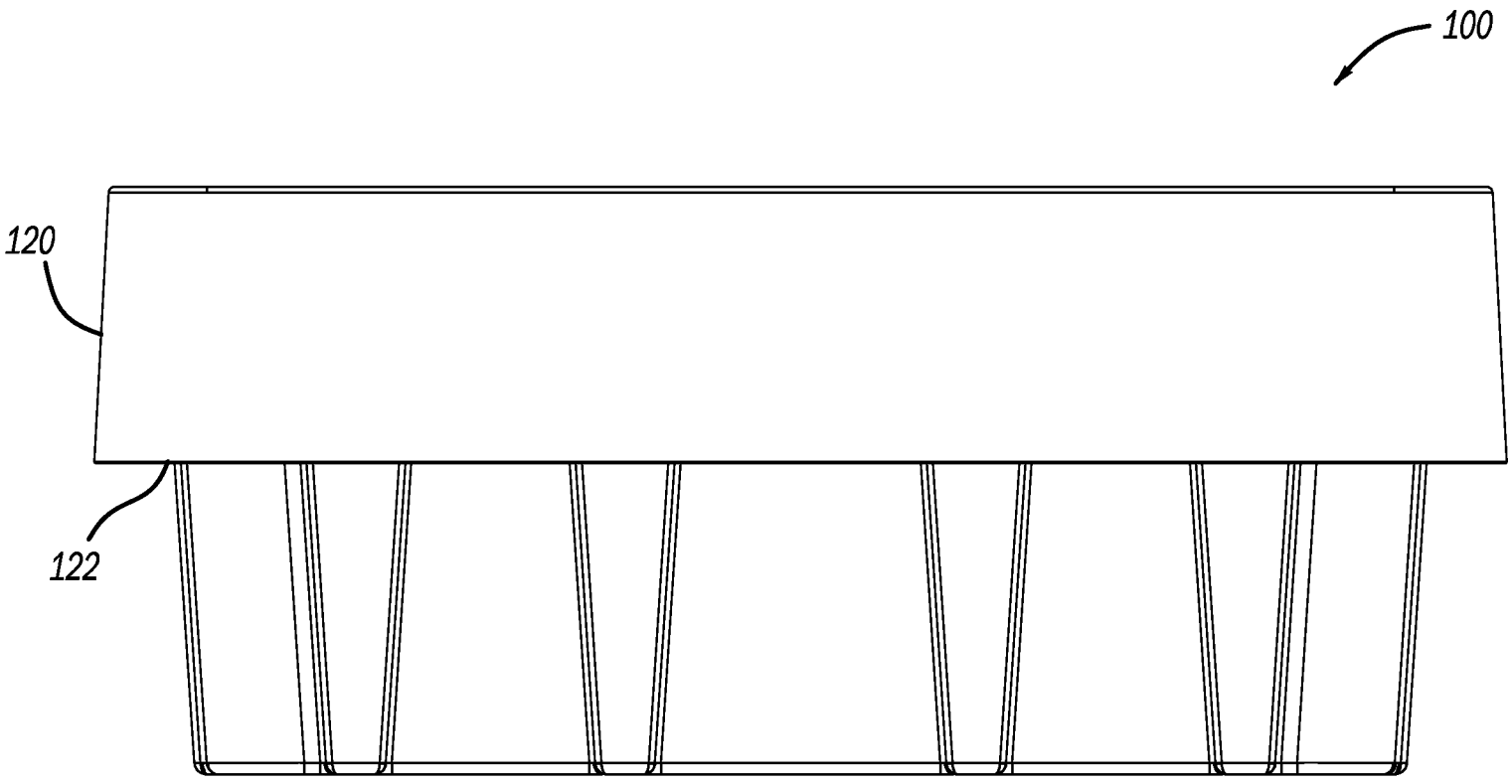
FIG. 5 is a side elevation view of the storage device for the storage system, in accordance with the present technology.
Figure 6:
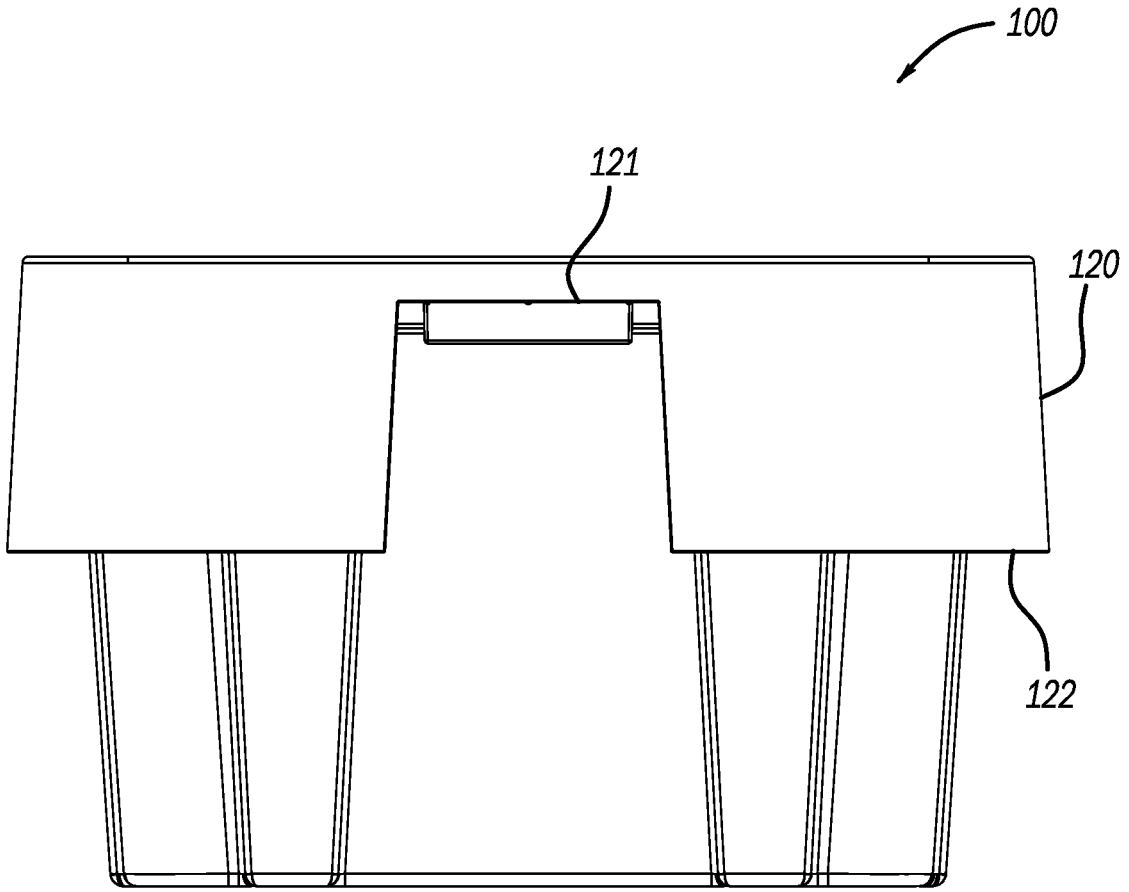
FIG. 6 is a front elevation view of the storage device for the storage system, in accordance with the present technology.
Figure 7:
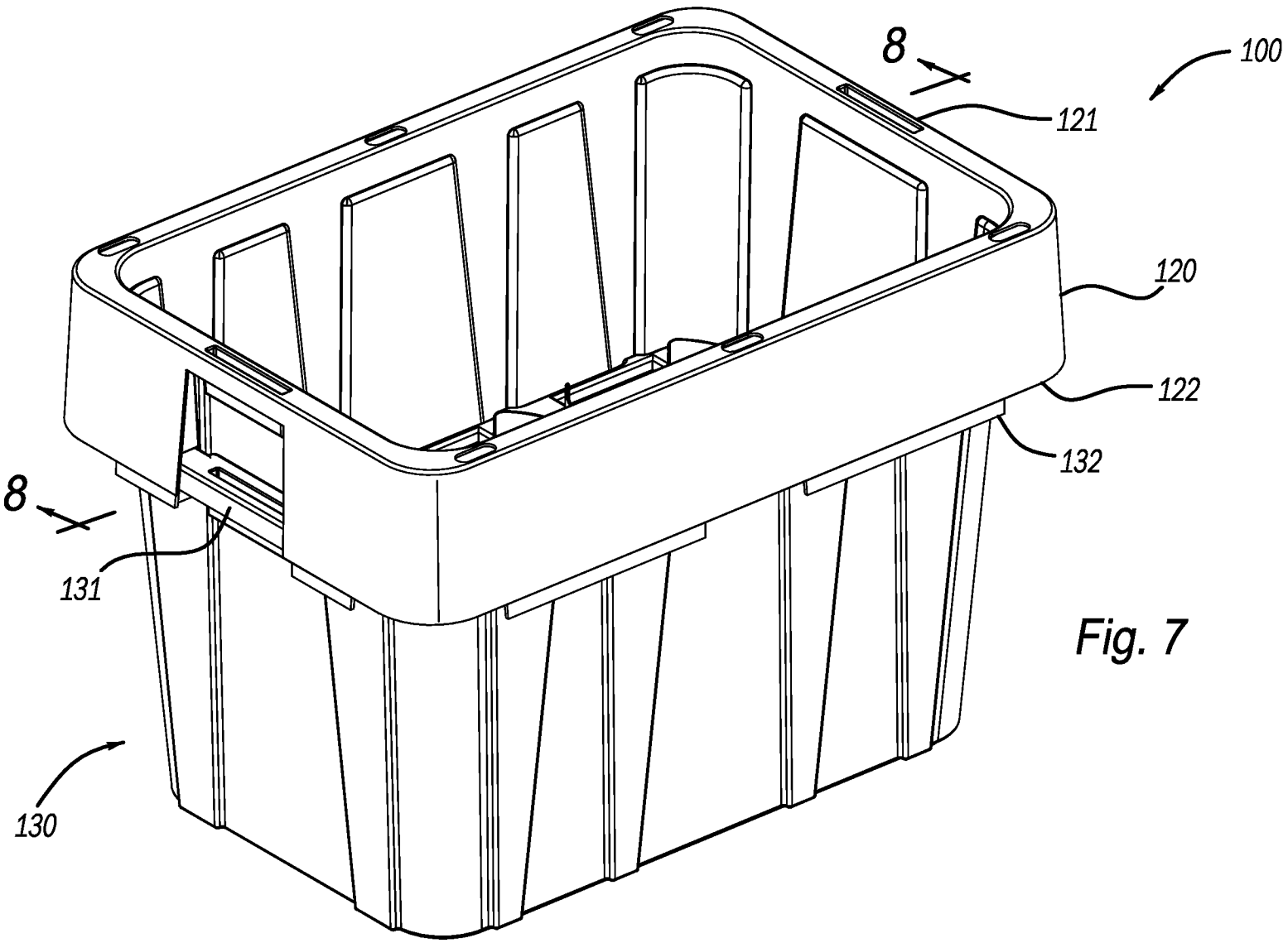
FIG. 7 is a top perspective view of the storage device received within the storage container, in accordance with the present technology.

FIG. 4 shows a bottom side of the storage device 100. As shown in FIG. 4, the storage device 100 includes one or more handles 121, an outside lip 120, and a bottom side 104' of the one or more retention means 104. The outside lip 120 includes the interior recess 122 which fits over an outside edge 131 of a storage container 130 and one or more ribbed surfaces 123 which fit on the outside edge 131 when the storage device 100 is placed into the storage container 130. In certain embodiments, the storage device 100 comprises a height that enables the storage device to be received within a storage container 130 such that a compartment 133 is formed therebetween the storage device 100 and the storage container 130. FIG. 5 shows a side elevation view of the storage device including the outside lip 120 and the interior recess 122. FIG. 6 shows a front view of the storage device 100 including the outside lip 120, one or more handles 121 and the interior recess 122.

As shown in FIGS. 7-10, the storage device 100 may selectively disposed into the storage container 130 for enhanced protection during storage and transport of one or more containers. As stated above, in certain embodiments, the body 101 may include one or more handles 121 and an outside lip 120. The outside lip 120 may include an interior recess 122 and one or more ribbed surfaces 123 which fit onto an outside edge 131 of the storage container. The storage device 100 may be sized so that the outside lip 120 and a size of the storage device 100 substantially matches a size of the outside edge 131 of a storage container 130. As shown in FIG. 8B, one or more tabs 124 may clip or otherwise snap onto the outside edge 131 to further secure the storage device 100 within the storage container 130.

Figure 8B:
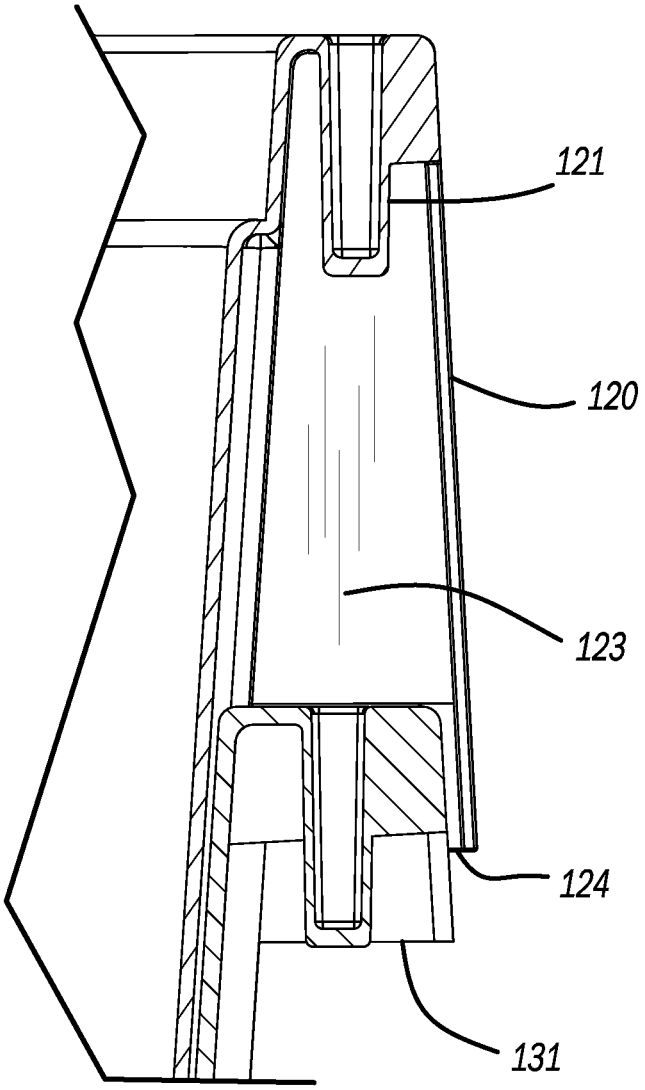
FIG. 8B is an enlarged view of an outside lip of the storage device and an outside edge of the storage container, in accordance with the present technology.

As shown in FIG. 8B, when the storage device 100 is inserted into the storage container 130, the outside lip 120 fits over an outside edge 131 of the storage container 130 and one or more tabs 124 may clip or otherwise snap onto the outside edge 131 to secure the storage device 100 within the storage container 130. In certain embodiments, a width of an interior recess 122 of the outside lip 120 may be sized such that it is able to expand and/or deform as it is pushed over the outside edge 131 and move back into place on and/over the outside edge 131 to hold the storage device 100 in place. Alternatively, or in conjunction, the storage device 100 may be held within the storage container 130 through a friction fit. The storage container 130 may be any appropriately desired storage container for receiving the storage device 100. In particular, as shown in FIG. 10, in certain embodiments, when the storage device 100 is received within the storage container 130, a side of the storage device 100 abuts the interior of the storage container 130 to provide a friction fit and the one or more ribbed surfaces 123 of the outside lip 120 fit onto the outside edge 131 to secure the storage device 100. The outside lip 120 may be appropriately sized to fit along the outside edge 131 of the storage container 130.

Figure 9A:
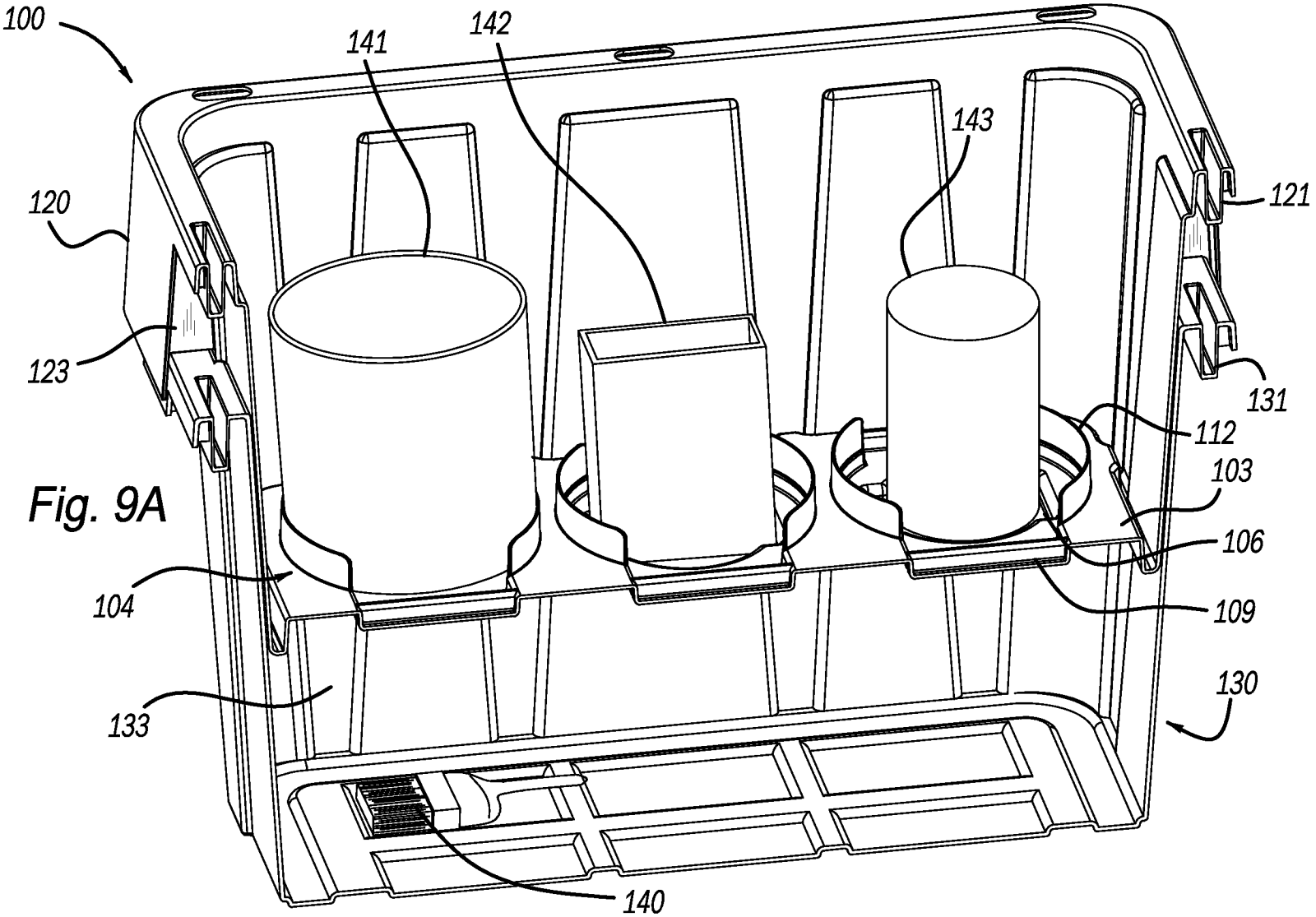
FIG. 9A is a cross-sectional view along the line 8-8 in FIG. 7 of the storage device received within the storage container, in accordance with the present technology.
Figure 9B:
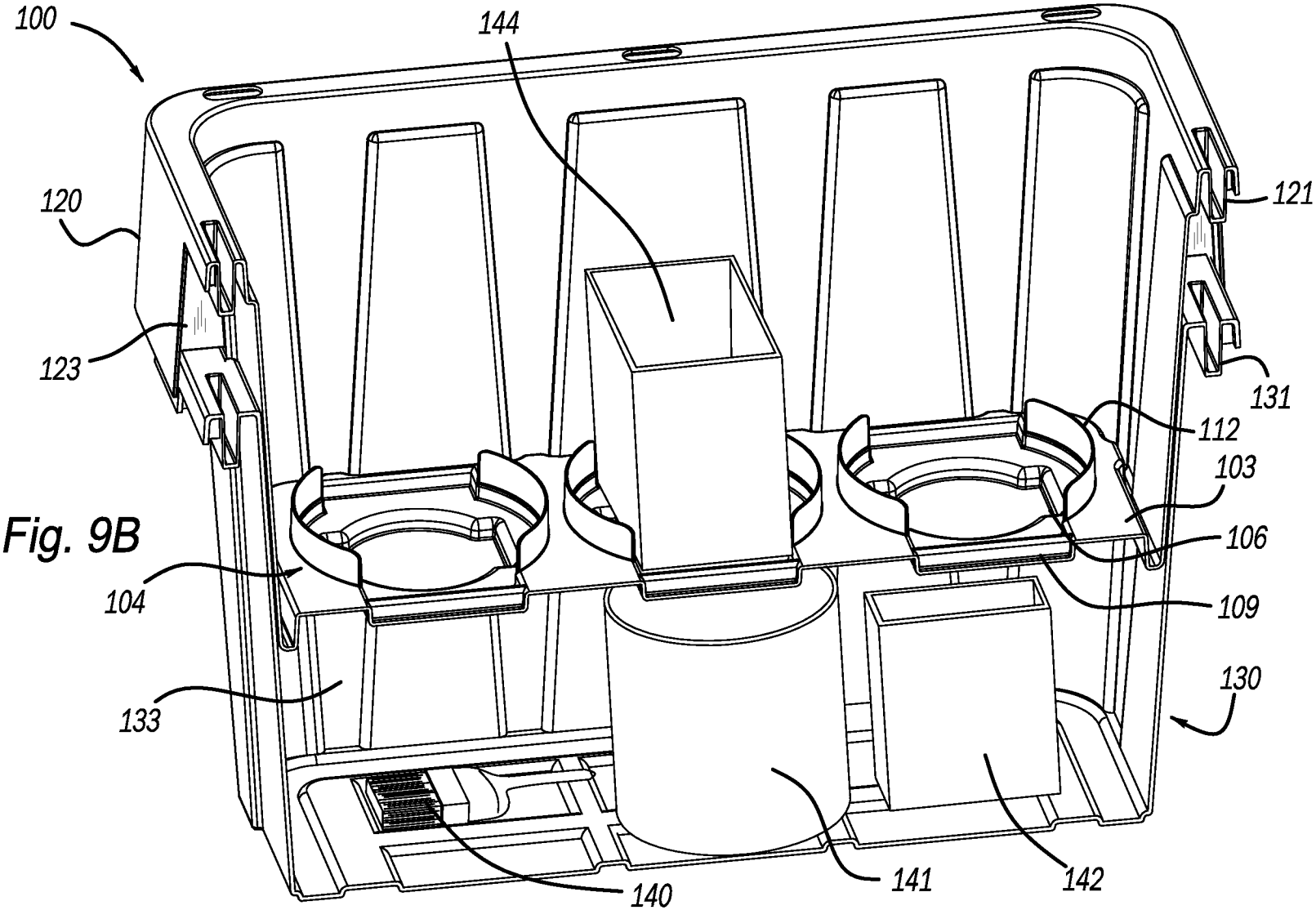
FIG. 9B is a cross-sectional view along the line 8-8 in FIG. 7 of the storage device received within the storage container, in accordance with the present technology.

As shown in FIGS. 8A-9B, the storage device may receive one or more substantially cylindrical containers 141 and 143 and substantially cuboid containers 142 and 144 of differing sizes. In particular, a larger cylindrical or cuboid container may be received by the first recess 106 and a smaller cylindrical or cuboid container may be received by the second recess 109 where it may be further supported by the protrusions 112 of the one or more retention means 104. As shown in FIGS. 9A and 9B, a substantially cuboid container 142 and 144 may be received within the one or more retention means 104 along its length, or longer horizontal side, and its width, or shorter horizontal side. In addition, when the storage device 100 is received within the storage container 130, a compartment 133 is formed therebetween that may store one or more tools and/or equipment 140 and additional containers, such as a cylindrical container 141 and a substantially cuboid container 142. Non-limiting examples of the one or more tools and/or equipment 140 may include paint keys, stir sticks, paint brushes, drop cloths, easels, and other items. In some embodiments, the storage container 130 may have a plurality of compartments for storing items when the storage device 100 is received within the storage container 130. In certain embodiments, the compartment 133 may be sized to receive one or more containers. For example, the compartment 133 may hold a substantially cylindrical container 141 and/or a substantially cuboid container 142 not received within the one or more retention means 104.

Figure 11:
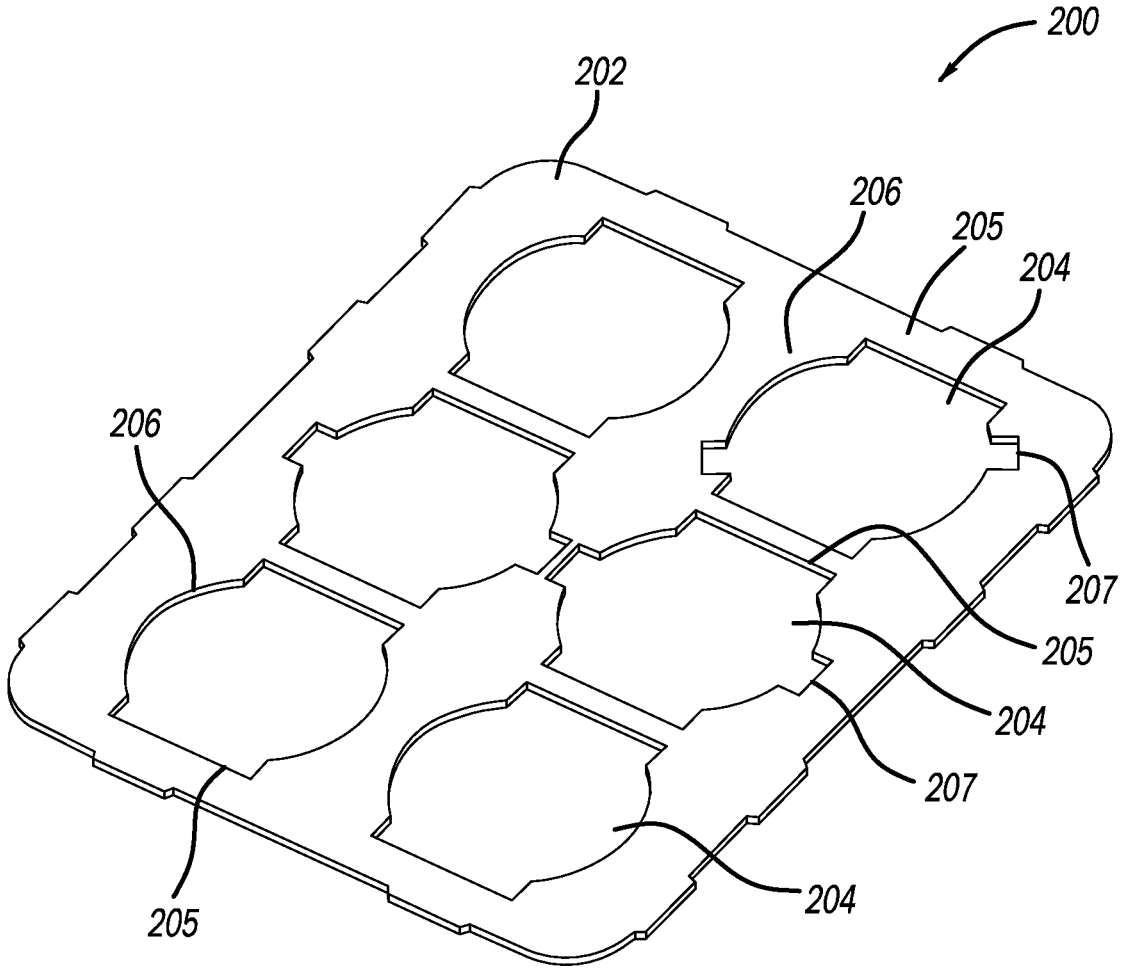
FIG. 11 is a top perspective view of another embodiment of a storage device for a storage system, in accordance with the present technology.

As shown in FIG. 11, a painting storage system 200 is provided that includes a tray 202 as a storage device, that has one or more retention means 204 configured to accept and support containers of one or more shape and/or size. In some embodiments, the one or more retention means 204 are similar to the one or more retention means 104, such as described above. The one or more retention means 204 may be one of a recess, a protrusion, or a combination of recesses and protrusions. The tray 202 may be configured to be selectively disposed into the storage container 130 for more protection of a container during storage and transport. In certain embodiments, the tray 202 may fit onto the storage device 100 after it has been placed within the storage container 130. Alternatively, the tray 202 may fit into the storage container on its own. In certain embodiments, when the tray 202 is received within the storage container 130, a side of the tray 202 abuts the interior of the storage container 130.

The tray 202 includes one or more retention means 204 with one or more substantially flat sides 205 and 207 and a plurality of substantially curved sides 206. In this manner, the one or more retention means 204 may separately accept a substantially cylindrical container, a substantially cuboid container, and a substantially square container. For example, in some embodiments, the retention means may accept and support a cylindrical container, such as a paint container and a cuboid container, such as a paint thinner container, and other square container. However, the retention means 204 may hold any desired cylindrical and/or cuboid shaped, and square containers as appropriately desired. It should also be appreciated that the one or more retention means 204 may be shaped for holding any appropriately shaped container. In some embodiments, more than one tray 202 may be placed within a storage container 130 for holding one or more containers.

Figure 12:
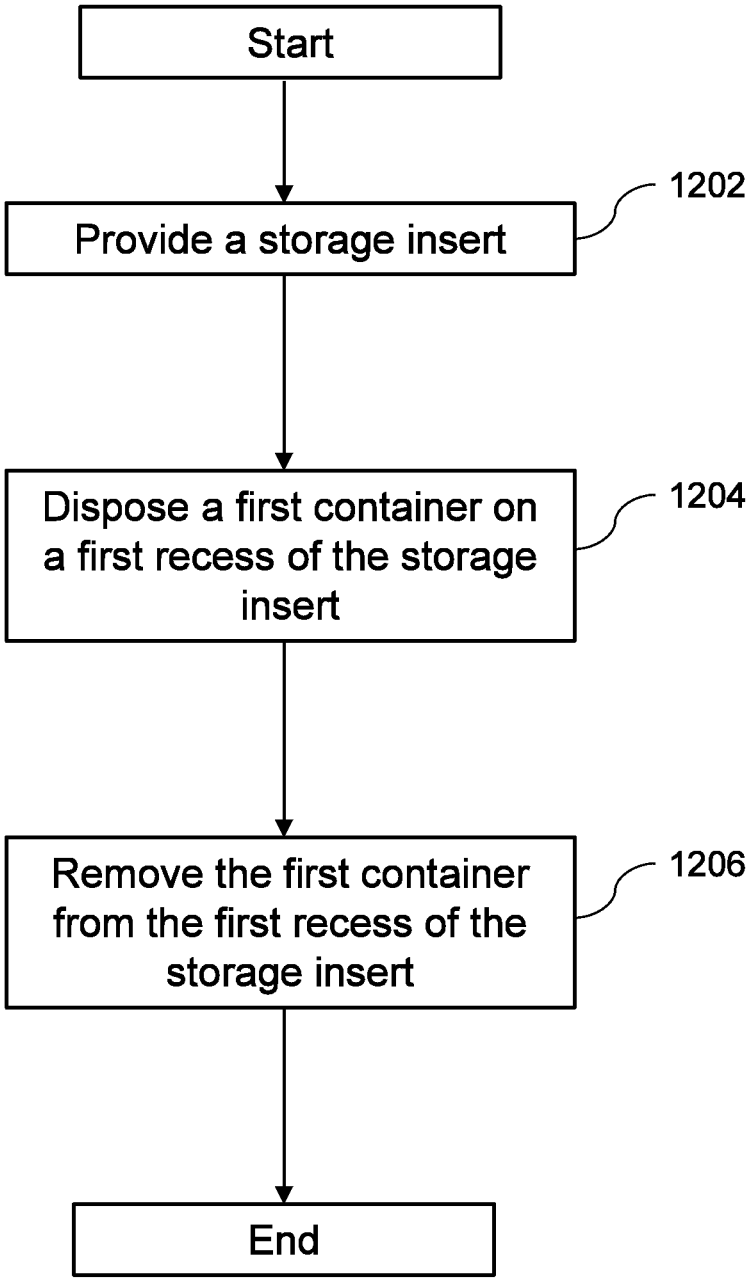
FIG. 12 is a flowchart of a method of using a storage system, in accordance with the present technology.

FIG. 12 shows a method of using a storage system, in accordance with the present technology. In step 1202, a storage device having a retention means configured to accept and support containers of more than one shape and sizes is provided. The retention means includes a first recess for accepting a first container and a second recess below the first recess for separately accepting a second container. The first container and the second container may comprise different sizes. In step 1204, the first container is disposed on the first recess. In the step 1206, the first container is removed from the first recess. The storage device may be removably placed into a storage container before the first container is disposed on the retention means. In certain embodiments, the when the storage device is placed within the storage container, it is removably held within the storage container by friction fit. A body of the storage device may include a plurality of raised sides and an outside lip that fits over an edge of the storage container to secure the storage device within the storage container. In certain embodiments, when the storage device is received within the storage container, a compartment is formed therebetween. One or more tools or other items may be placed within the compartment before removably placing the storage device into the storage container.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A storage device, comprising:

a body including one or more retention means, each retention means configured to accept and support a plurality of differently sized containers, each retention means includes a first recess, wherein the body further includes a top surface disposed on a first plane, the first recess having a bottom surface disposed on a second plane at a first distance beneath the first plane, and the first plane and the second plane are parallel, wherein the first recess is elongated and oriented on a primary axis and defined by a first curved wall, a second curved wall, a first flat wall, a second flat wall, and two pairs of connecting walls extending from the bottom surface, the first curved wall disposed opposite the second curved wall, the first flat wall disposed opposite the second flat wall, and each of the first curved wall and the second curved wall connected to each of the first flat wall and the second flat wall with one of the two pairs of connecting walls, the first flat wall and the second flat wall disposed substantially perpendicular to the primary axis, the first curved wall and the second curved wall extending above the top surface, and whereby the first recess is configured to engage and securely hold a first container and position the first container atop the second plane regardless of the first container being a substantially cylindrical container or a substantially cuboid container.

2. The storage device of claim 1, wherein each retention means further includes a second recess within the first recess, the second recess having a second bottom surface disposed on a third plane at a second distance beneath the second plane, and the second plane and the third plane are parallel, wherein the second recess is elongated and defined by a third curved wall, a fourth curved wall, a third flat wall, a fourth flat wall, and two other pairs of connecting walls extending from the second bottom surface, the third curved wall disposed opposite the fourth curved wall, the third flat wall disposed opposite the fourth flat wall, and each of the third curved wall and the fourth curved wall connected to each of the third flat wall and the fourth flat wall with one of the two other pairs of connecting walls, the third flat wall and the fourth flat wall disposed substantially parallel to the primary axis of the first recess, and whereby the second recess is configured to separately engage and securely hold a second container and position the second container atop the third plane regardless of the second container being a substantially cylindrical container or a substantially cuboid container, the first container and the second container comprising different sizes.

3. The storage device of claim 2, wherein each of the first recess and the second recess is configured to engage a substantially cylindrical container and engage a substantially cuboid container.

4. The storage device of claim 1, including one or more raised walls.

5. The storage device of claim 4, wherein the one or more raised walls include an outside lip along an edge of the one or more raised walls.

6. The storage device of claim 5, wherein the outside lip is defined by an interior recess on an underside of the outside lip.

7. A storage system comprising:

a storage device including a body including one or more retention means, each retention means configured to accept and support a plurality of differently sized containers, wherein each retention means includes a first recess configured to engage a substantially cylindrical container and engage a substantially cuboid container;

wherein the body further includes a top surface disposed on a first plane, the first recess having a bottom surface disposed on a second plane at a first distance beneath the first plane, and the first plane and the second plane are parallel, wherein the first recess is elongated and oriented on a primary axis and defined by a first curved wall, a second curved wall, a first flat wall, a second flat wall, and two pairs of connecting walls extending from the bottom surface, the first curved wall disposed opposite the second curved wall, the first flat wall disposed opposite the second flat wall, and each of the first curved wall and the second curved wall connected to each of the first flat wall and the second flat wall with one of the two pairs of connecting walls, the first flat wall and the second flat wall disposed substantially perpendicular to the primary axis, the first curved wall and the second curved wall extending above the top surface, and whereby the first recess is configured to engage and securely hold a first container and position the first container atop the second plane regardless of the first container being a substantially cylindrical container or a substantially cuboid container; and a storage container, wherein the storage device is configured to be removably held within the storage container.

8. The storage system of claim 7, wherein the storage device is configured to be removably held within the storage container by a friction fit when the storage device is placed within the storage container.

9. The storage system of claim 7, wherein the body of the storage device includes a raised side having an outside lip that fits over an edge of the storage container to secure the storage device within the storage container.

10. The storage system of claim 9, wherein the outside lip includes one or more tabs that snap onto the edge of the storage container to secure the storage device within the storage container.

11. The storage system of claim 7, wherein when the storage device is received within the storage container, a compartment is formed therebetween that is configured to store one or more tools and equipment.

12. A METHOD of USING a storage device, the METHOD comprising:

PROVIDING a storage device, the storage device including a body including one or more retention means, each retention means configured to accept and support a plurality of differently sized containers, each retention means includes a first recess, wherein the body further includes a top surface disposed on a first plane, the first recess having a bottom surface disposed on a second plane at a first distance beneath the first plane, and the first plane and the second plane are parallel, wherein the first recess is elongated and oriented on a primary axis and defined by a first curved wall, a second curved wall, a first flat wall, a second flat wall, and two pairs of connecting walls extending from the bottom surface, the first curved wall disposed opposite the second curved wall, the first flat wall disposed opposite the second flat wall, and each of the first curved wall and the second curved wall connected to each of the first flat wall and the second flat wall with one of the two pairs of connecting walls, the first flat wall and the second flat wall disposed substantially perpendicular to the primary axis, the first curved wall and the second curved wall extending above the top surface, and whereby the first recess is configured to engage and securely hold a first container and position the first container atop the second plane regardless of the first container being a substantially cylindrical container or a substantially cuboid container; and PERFORMING one of:

DISPOSING a first container in the first recess; and

REMOVING the first container from the first recess.

13. The METHOD of claim 12, further comprising PERFORMING one of:

RECEIVING the storage device into a storage container, wherein when the storage device is received within the storage container, a compartment is formed therebetween that is configured to store one or more tools and equipment; and REMOVING the storage device from the storage container.

14. The METHOD of claim 13, further comprising PERFORMING one of:

DISPOSING one or more tools in the compartment before RECEIVING the storage device into the storage container; and REMOVING one or more tools from the compartment after REMOVING the storage device from the storage container.

15. The METHOD of USING a storage device of claim 12, wherein each retention means further includes a second recess within the first recess, the second recess having a second bottom surface disposed on a third plane at a second distance beneath the second plane, and the second plane and the third plane are parallel, wherein the second recess is elongated and defined by a third curved wall, a fourth curved wall, a third flat wall, a fourth flat wall, and two other pairs of connecting walls extending from the second bottom surface, the third curved wall disposed opposite the fourth curved wall, the third flat wall disposed opposite the fourth flat wall, and each of the third curved wall and the fourth curved wall connected to each of the third flat wall and the fourth flat wall with one of the two other pairs of connecting walls, the third flat wall and the fourth flat wall disposed substantially parallel to the primary axis of the first recess, and whereby the second recess is configured to separately engage and securely hold a second container and position the second container atop the third plane regardless of the second container being a substantially cylindrical container or a substantially cuboid container, the first container and the second container comprising different sizes.

* * * * *